US011646186B2

(12) United States Patent
Madathil

(10) Patent No.: US 11,646,186 B2
(45) Date of Patent: May 9, 2023

(54) SYSTEM AND METHOD FOR OPTIMIZING PEAK SHAPES

(71) Applicant: ATONARP INC., Tokyo (JP)

(72) Inventor: Karthikeyan Rajan Madathil, Karnataka (IN)

(73) Assignee: ATONARP INC., Tokyo (JP)

( * ) Notice: Subject to any disclaimer, the term of this patent is extended or adjusted under 35 U.S.C. 154(b) by 387 days.

(21) Appl. No.: 16/957,405

(22) PCT Filed: Jan. 8, 2019

(86) PCT No.: PCT/JP2019/000125
§ 371 (c)(1),
(2) Date: Jun. 24, 2020

(87) PCT Pub. No.: WO2019/138977
PCT Pub. Date: Jul. 18, 2019

(65) Prior Publication Data

US 2020/0335316 A1 Oct. 22, 2020

(30) Foreign Application Priority Data

Jan. 9, 2018 (IN) ..... 201841000946

(51) Int. Cl.
*H01J 49/00* (2006.01)

(52) U.S. Cl.
CPC ..... *H01J 49/0036* (2013.01); *H01J 49/0009* (2013.01)

(58) Field of Classification Search
CPC ..... H01J 49/0036; H01J 49/0009; H01J 49/0027; G01N 27/62
See application file for complete search history.

(56) References Cited

U.S. PATENT DOCUMENTS

2005/0086017 A1 4/2005 Wang
2013/0080073 A1 3/2013 de Corral
(Continued)

FOREIGN PATENT DOCUMENTS

EP 2306180 A1 4/2011
EP 2530621 A2 * 12/2012 ..... G01T 7/005
(Continued)

OTHER PUBLICATIONS

Examination Report issued Indian Patent Application No. 2020047026029, dated Apr. 29, 2022, with English Translation (5 pages).
(Continued)

*Primary Examiner* — Roy Y Yi
*Assistant Examiner* — Geoffrey T Evans
(74) *Attorney, Agent, or Firm* — Buchanan Ingersoll & Rooney PC

(57) ABSTRACT

A system includes a first type of sensor and an estimation system that is connected to first type of sensor. The estimation system is configured to (a) identify a best peak shape for estimation of known gas mixtures by analyzing characterization data across known gas mixtures, with added noise, using machine learning, (b) generate a plurality of actual peak shapes, in first type of sensor, for several different instances using standard gas mixtures to provide an actual peak shape among the plurality of peak shapes as calibrating input to calibrate first type of sensor and (c) calibrate first type of sensor by automatically adjusting parameters of first type of sensor for optimizing actual peak shape to match with desired peak shape.

15 Claims, 7 Drawing Sheets

(56) References Cited

U.S. PATENT DOCUMENTS

| | | | |
|---|---|---|---|
| 2014/0297201 | A1 | 10/2014 | Knorr et al. |
| 2017/0133215 | A1 | 5/2017 | Remes et al. |
| 2017/0140299 | A1 | 5/2017 | Tanji |

FOREIGN PATENT DOCUMENTS

| | | | |
|---|---|---|---|
| EP | 3041027 | A1 | 7/2016 |
| WO | 2005117063 | A2 | 12/2005 |
| WO | 2008100941 | A2 | 8/2008 |
| WO | 2008151153 | A1 | 12/2008 |

OTHER PUBLICATIONS

International Search Report (PCT/ISA/210) dated Mar. 26, 2019, by the Japanese Patent Office as the International Searching Authority for International Application No. PCT/JP2019/000125.
Written Opinion (PCT/ISA/237) dated Mar. 26, 2019, by the Japanese Patent Office as the International Searching Authority for International Application No. PCT/JP2019/000125.

* cited by examiner

[Fig. 1]
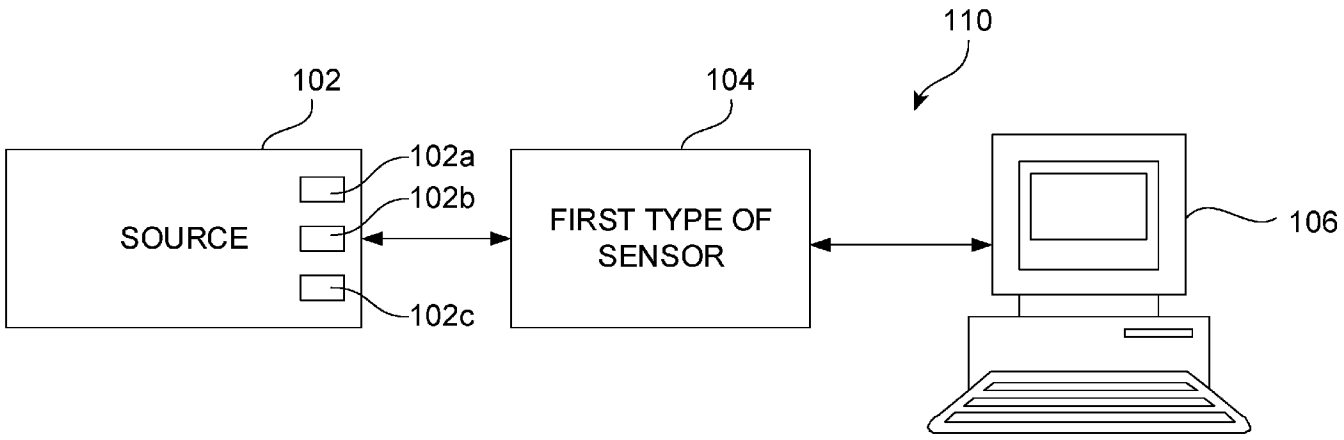

[Fig. 2]
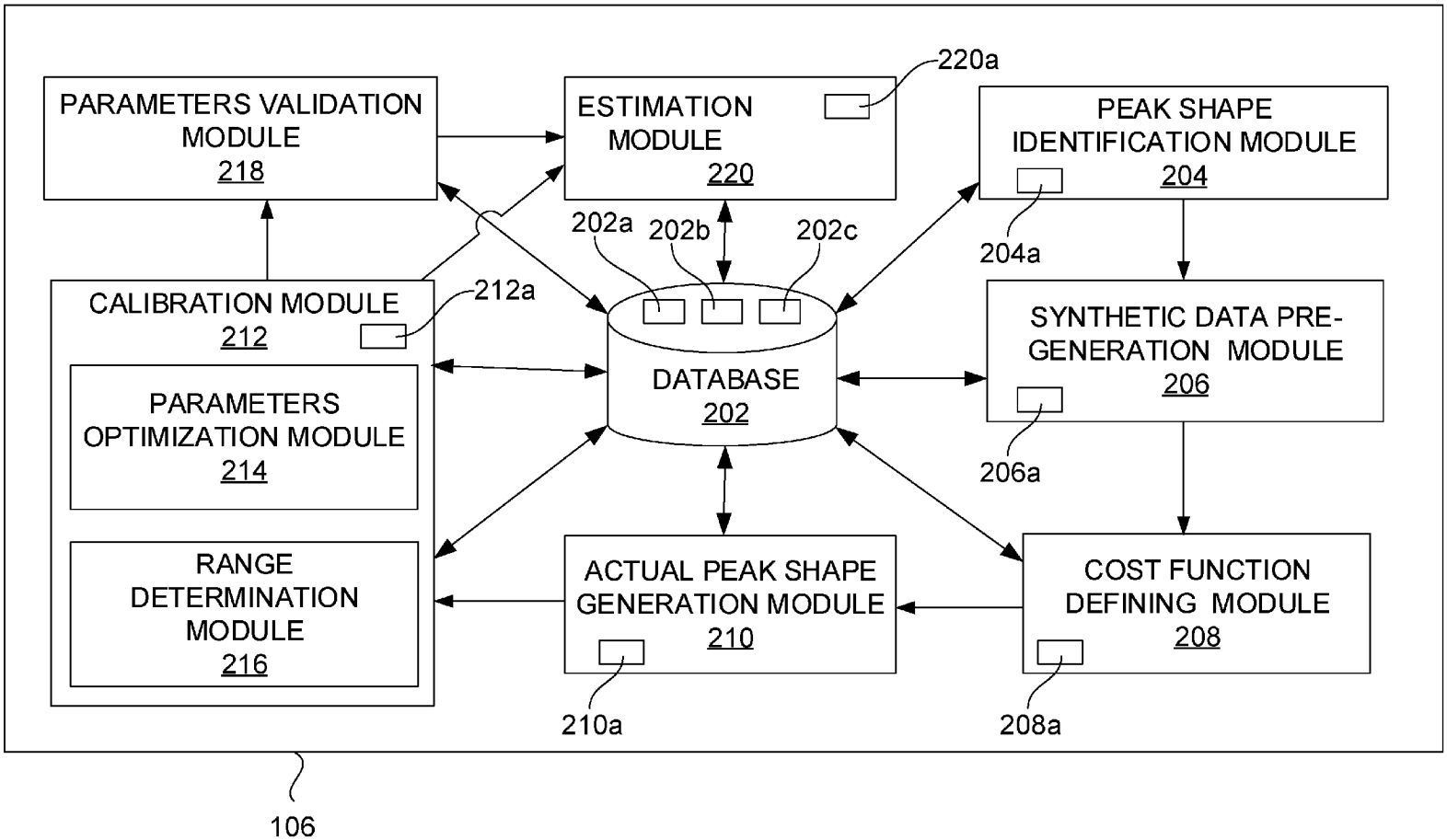

[Fig. 3]
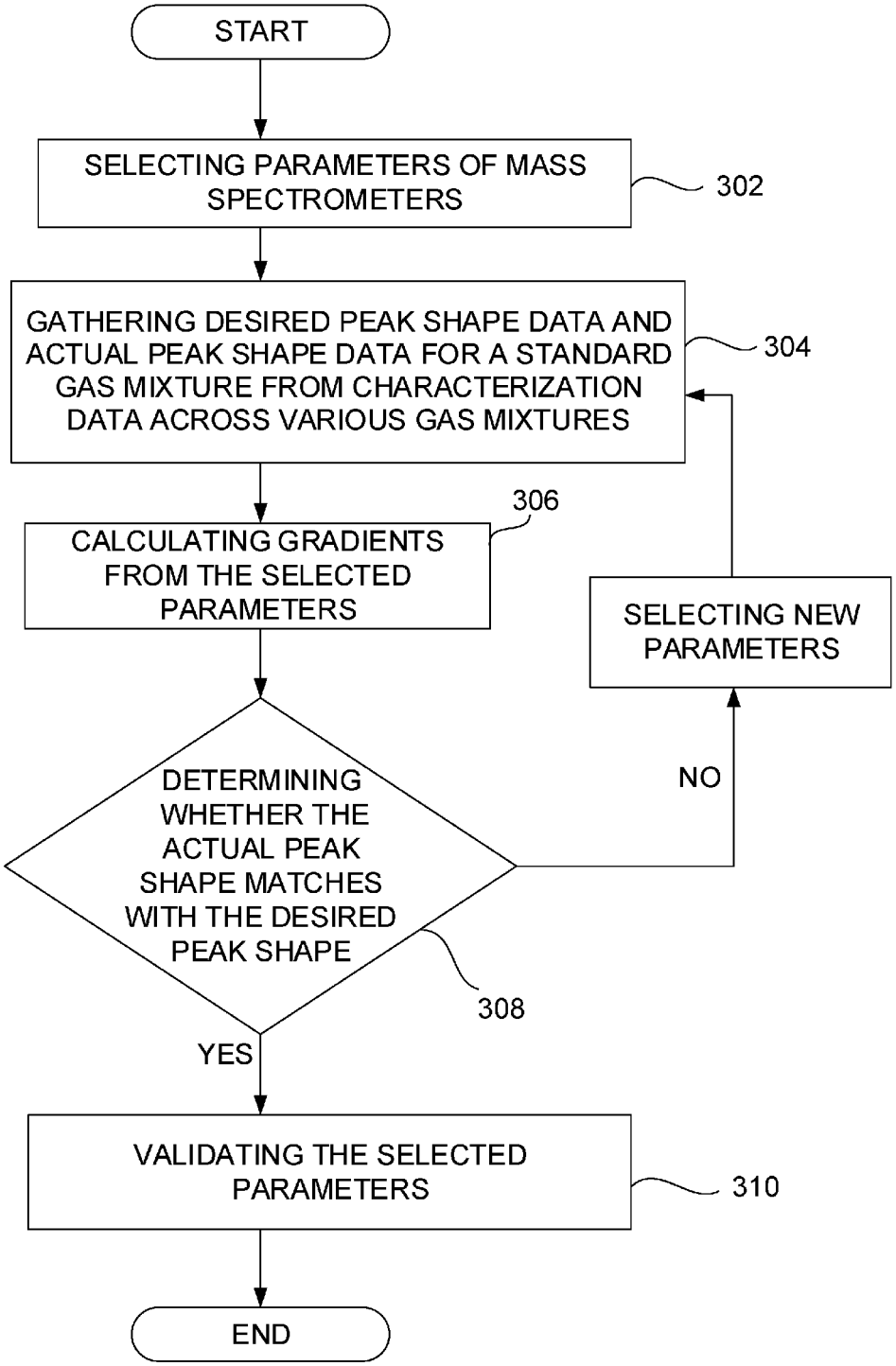

[Fig. 4A]
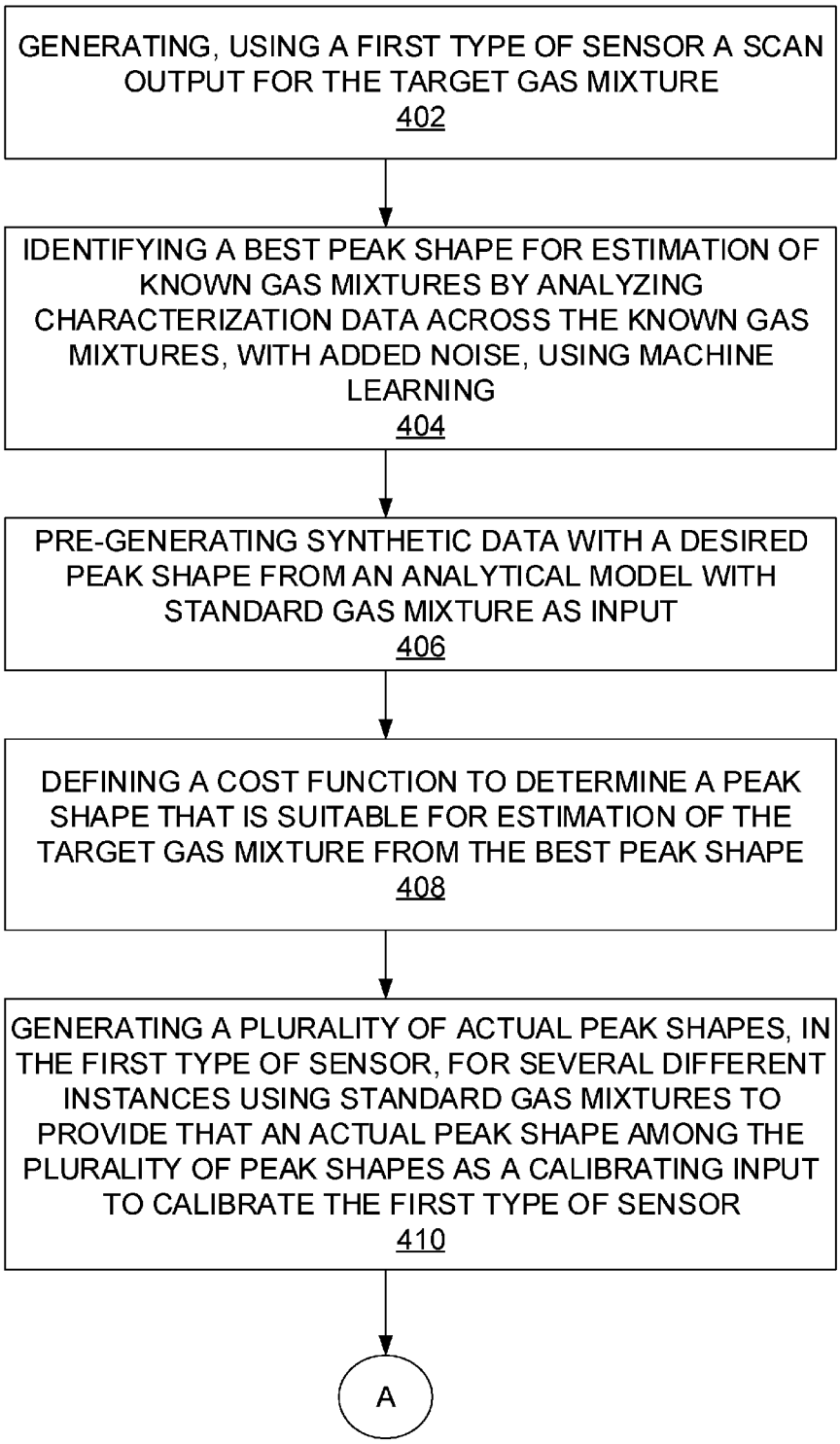

[Fig. 4B]
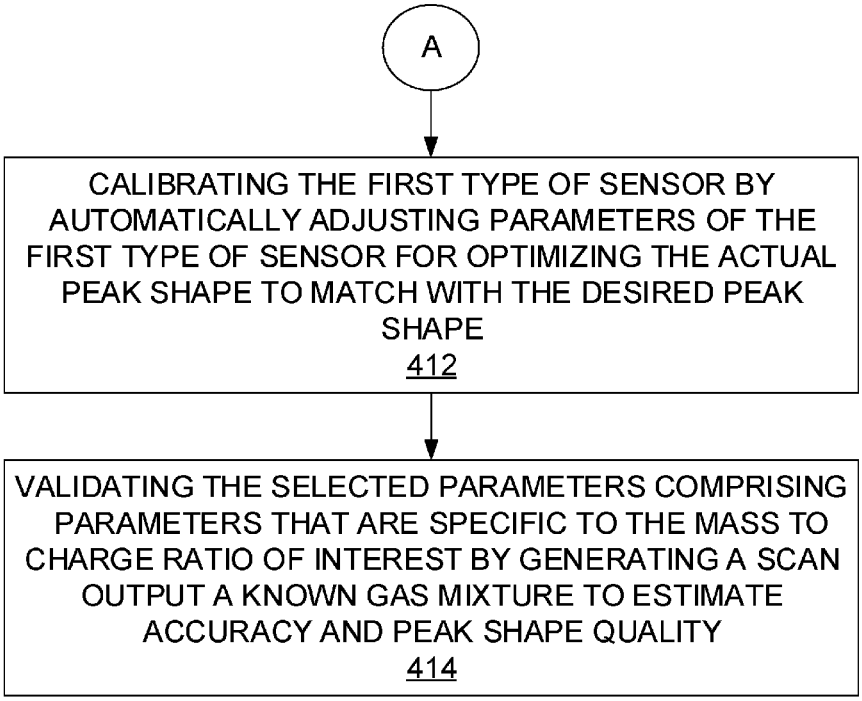

[Fig. 5]
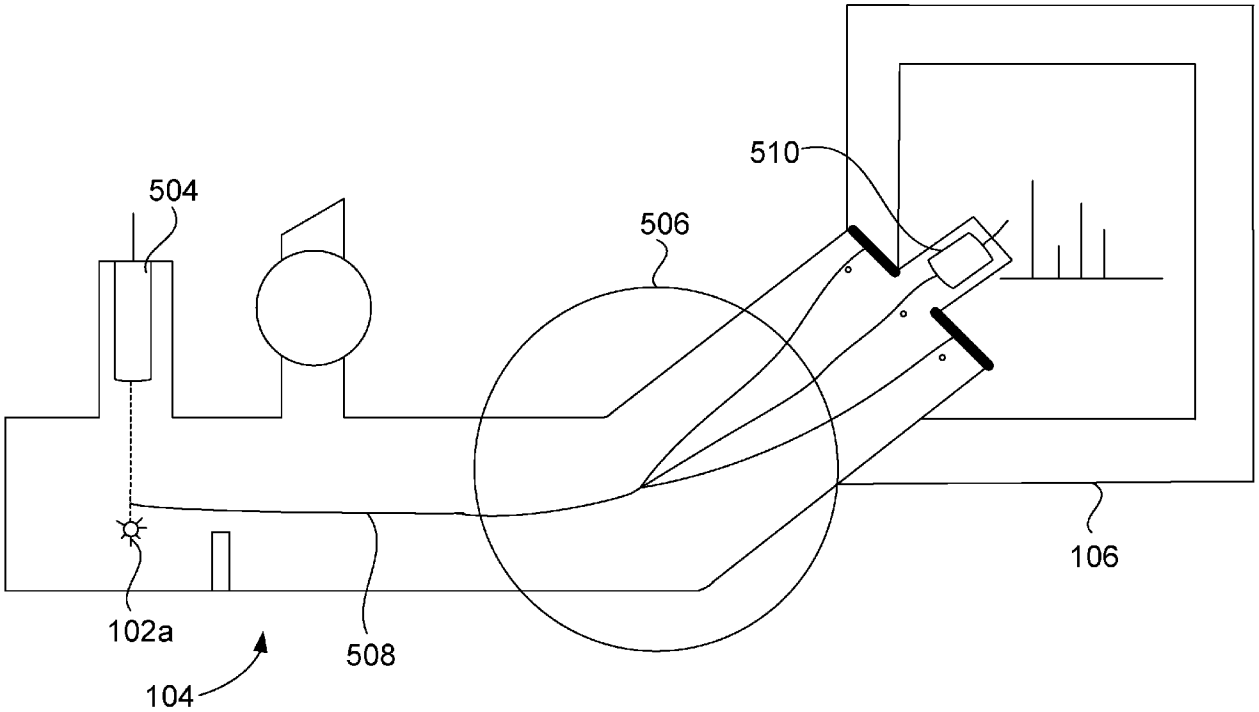

[Fig. 6]
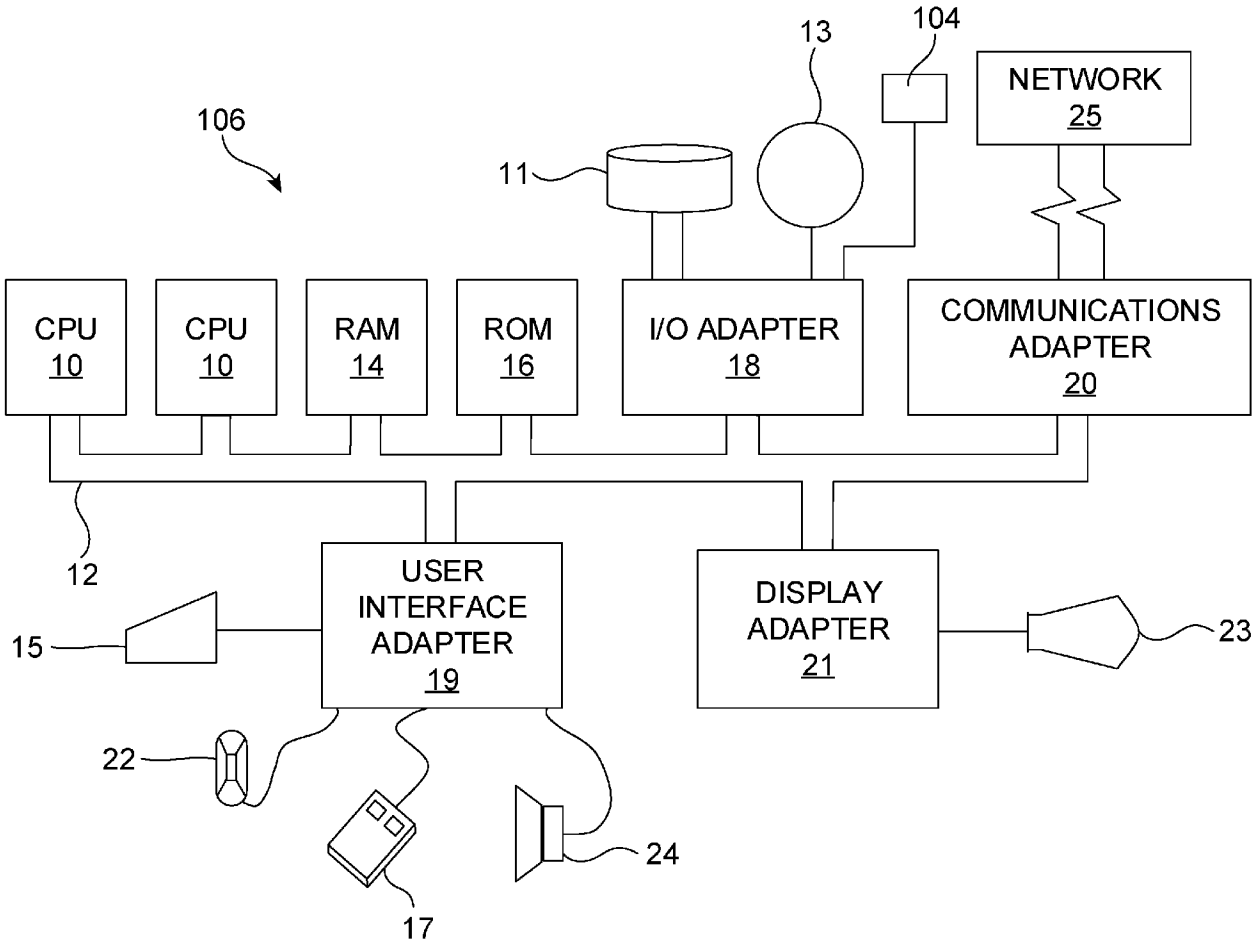

SYSTEM AND METHOD FOR OPTIMIZING PEAK SHAPES

TECHNICAL FIELD

The embodiments herein generally relate to a system for optimizing peak shapes for a spectrometer, and, more particularly, to a system and a method for automatically optimizing peak shapes for a spectrometer such as a mass spectrometer for estimating gas mixtures.

BACKGROUND ART

The standard mass spectrometer produces a signature appearing at multiple mass to charge ratios (m/z ratios) associated with its ions and their fragments. The mass spectrometer may ionize different gases at different relative rates. Ions of the different gases may be fragmented and may appear at various mass to charge ratios (i.e. m/zs). The fragmented ions at various mass to charge ratios are transmitted to a detector. The fragmentation of the ion may be constant for one gas.

Mass spectrometer data typically shows "peaks" corresponding to individual ions with different mass to charge (m/z) ratios. The fragmentation of the ions may be obtained from a standard reference database or by experiment. Each peak of the fragmented ions typically includes a non-zero width, and possibly asymmetric shape which depends on the mass to charge ratio. The peak of the fragmented ions is varied between different classes of mass spectrometer instruments as the peak of the fragmented ions is specified based on the mass spectrometer. A perfectly ideal mass spectrometer has peaks of zero width (impulses), while every actual mass spectrometer shows peaks of non-zero width, and shapes varying from neat Gaussian or Lorentzian curves to combinations of multiple peaks curves overlapping each other.

In conventional mass spectrometers, each mass spectrometer employs an estimation algorithm for adapting to the peak shapes produced by the mass spectrometers. These mass spectrometers need an algorithm tuning steps where the algorithms implemented in each mass spectrometer is tuned to the specific peak shapes that a mass spectrometer produces. One of the approaches for shaping the overlapping peaks involves de-convoluting the shape of the overlapping peaks using a de-convolution process.

However, the de-convolution process fails to extract information from the minor peaks that are hidden under larger adjacent peaks. Moreover, this approach is an instrument specific calibration with a limited set of scaling factors. Further the above said approach has limited estimation accuracy, variations from unit to unit and limited sensitivity at higher mass to charge ratios. Said approach has been also adapted to other spectroscopic type sensors such as a Raman spectrometer, an absorption spectrometer or a vibrational spectrometer.

Accordingly, there remains a need for a system and a method that automatically optimizes any peak shapes for a mass spectrometer and other spectroscopic type sensors for estimating gas and other mixtures by automatically optimizing parameters of the sensors.

SUMMARY OF INVENTION

One of aspect of this invention is a system for estimating compositions of a target mixture using a first type sensor. The first type sensor generates a scan output for the target mixture. The scan output including spectra of detected compositions as a function of a first variable such as mass-to-charge ratio, wave number and others. The system comprises a data base and a set of modules. The data base stores characterization data of known mixtures, a set of constraints that includes accuracy, sensitivity and resolution required for an application to that the system applies, and an analytical model of a standard mixture. The set of modules comprises a peak shape identification module, a synthetic data pre-generation module, a cost function defining module, an actual peak shape generation module, a calibration module and an estimation module. The peak shape identification module is configured to identify a best peak shape for estimation of the compositions of the known mixtures such as know gas mixtures by analyzing the characterization data across the known mixtures, with added noise as a background of the application, wherein the best peak shape is referred as a peak shape meets the set of constraints of the application best. The synthetic data pre-generation module is configured to pre-generate synthetic data with a desired peak shape that is corresponding to the best peak shape from the analytical model with the standard mixture as input. The desired peak shape may be a peak shape of a part of spectra that has the same range of the best peak shape. The cost function defining module is configured to define a cost function to determine a peak shape that is suitable for estimation of the compositions of the target mixture from the best peak shape. The actual peak shape generation module is configured to generate a plurality of actual peak shapes, in the first type of sensor, for several different instances using the standard mixture to provide that an actual peak shape among the plurality of actual peak shapes as a calibrating input to calibrate the first type of sensor. The calibration module is configured to calibrate the first type of sensor by automatically adjusting parameters of the first type of sensor to find selected parameters for optimizing the actual peak shape to match with the desired peak shape. The estimation module is configured to estimate the compositions of the target mixture using the cost function from a peak shape of a scan output of first type sensor generating with the selected parameters.

In this system, the estimation module can estimate the compositions of the target mixture using the cost function from a peak shape of a scan output calibrated by the standard mixture without using de-convoluting the shape of the peaks included in the scan output.

The set of modules may further include a parameters validation module that is configured to validate the selected parameters by generating a scan output of a known mixture to estimate accuracy and peak shape quality. The best peak shape identification module identifies the best peak shape with added noise using machine learning.

The first type of sensor may generate a scan output for a target gas mixture, the scan output comprising the spectra of detected ions as a function of the mass-to-charge ratio corresponding to the target gas mixture. The calibration module calibrates the first type of sensor by adjusting the parameter comprises at least one of a Radio Frequency voltage to Direct Current voltage ratio, an Emission Current, voltage gradients and a bias voltage.

The calibration modules may include: (a) an optimizing module that is configured to optimize the parameters for a mass to charge ratio of interest once the parameters to be adjusted are selected; and (b) a determining module that is configured to determine each of the selected parameters is in a predefined range by constraining (i) optimization of the actual peak shape and (ii) optimization of each of the selected parameters to respective predefined range. The first type of sensor may include a mass spectrometer including a quadrupole mass filter. The selected parameter may include the voltage gradients and individual bias voltage comprising (i) box bias, (ii) Filament bias, (iii) Lens bias, (iv) Exit lens bias and (v) quadrupole bias.

The system may further comprise a memory that stores the database and the set of modules, and a processor that executes the set of modules. The system may further comprise a first type of sensor.

Another aspect of this invention is a method implemented on a computer that includes estimating compositions of a target mixture using a first type sensor. The first type sensor generates a scan output for the target mixture and the scan output includes spectra of detected compositions as a function of a first variable. The estimating composition includes: (a) identifying a best peak shape for estimation of the compositions of known mixtures by analyzing characterization data across the known mixtures, with added noise as a background of an application, wherein the best peak shape is referred as for a given set of constraints that includes accuracy, sensitivity and resolution in the application, a peak shape meets the set of constraints best; (b) pre-generating synthetic data with a desired peak shape that is corresponding to the best peak shape from an analytical model with standard mixture as input; (c) defining a cost function to determine a peak shape that is suitable for estimation of the compositions of the target mixture from the best peak shape; (e) generating a plurality of actual peak shapes, in the first type of sensor, for several different instances using the standard mixture to provide that an actual peak shape among the plurality of actual peak shapes as a calibrating input to calibrate the first type of sensor; (f) calibrating the first type of sensor by automatically adjusting parameters of the first type of sensor to find selected parameters for optimizing the actual peak shape to match with the desired peak shape; and (g) generating a scan output of the target mixture of the first type sensor with the selected parameters to estimate the compositions of the target mixture using the cost function from a peak shape in the scan output.

The estimating composition may further include validating the selected parameters by generating a scan output of a known mixture to estimate accuracy and peak shape quality. The step of identifying the best peak shape may include identifying the best peak shape with added noise using machine learning.

The first type of sensor may generate a scan output for a target gas mixture. The scan output may include the spectra of detected ions as a function of the mass-to-charge ratio corresponding to the target gas mixture. The step of calibrating may include calibrating the first type of sensor by adjusting the parameter comprising at least one of a Radio Frequency voltage to Direct Current voltage ratio, an Emission Current, voltage gradients and a bias voltage. The step of calibrating may include: (a) optimizing the parameters for a mass to charge ratio of interest once the parameters to be adjusted are selected; and (b) determining each of the selected parameters is in a predefined range by constraining (i) optimization of the actual peak shape and (ii) optimization of each of the selected parameters to respective predefined range.

The first type of sensor may include a mass spectrometer including a quadrupole mass filter and the selected parameter may include the voltage gradients and individual bias voltage comprising (i) box bias, (ii) Filament bias, (iii) Lens bias, (iv) Exit lens bias and (v) quadrupole bias.

BRIEF DESCRIPTION OF DRAWINGS

The embodiments herein will be better understood from the following detailed description with reference to the drawings, in which:

FIG. 1 illustrates a system for optimizing a peak shape for estimating a composition of a target gas mixture using an estimation system according to an embodiment herein;

FIG. 2 illustrates an exploded view of the estimation system of FIG. 1 according to an embodiment herein;

FIG. 3 is a flow diagram that illustrates a calibration control loop for the estimation system of FIG. 1 according to an embodiment herein;

FIG. 4A is a flow diagram that illustrates a method for optimizing a peak shape for estimating a composition of the target gas mixture using the estimation system of FIG. 1 according to an embodiment herein;

FIG. 4B is a flow diagram following FIG. 4A;

FIG. 5 illustrates a perspective view of a first type of sensor (a mass spectrometer) of FIG. 1 according to an embodiment herein; and FIG. 6 illustrates a schematic diagram of computer architecture of the estimation system in accordance with the embodiments herein.

DESCRIPTION OF EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a system and a method that automatically optimizing peak shapes (i.e. Gaussian or Lorentzian curves or combinations of multiple peaks curves overlapping) for estimating a composition of a target mixture. The embodiments herein achieve this by providing an estimation system that generates an actual peak shape using standard mixtures to provide that actual peak shape as a calibrating input to calibrate the first type of sensor. Referring now to the drawings, and more particularly to FIGS. 1 through 6, where similar reference characters denote corresponding features consistently throughout the figures, preferred embodiments are shown.

FIG. 1 illustrates a system 110 for optimizing a peak shape for estimating a composition of a target gas mixture using an estimation system 106 according to an embodiment herein. The system 110 includes a source 102, a first type of sensor 104 and the estimation system 106. The source 102 includes a target gas mixture 102*a*, and a standard gas mixture or mixtures 102*b*. The source 102 may include one or more known gas mixtures 102*c* for validating the selected parameter for the first type of sensor 104. The standard gas mixture 102*b* is one whose composition is known and is commonly available for an application to which the estimation system 106 applies. For example, the hydrocarbon industry uses a set of standard gas mixtures to evaluate the accuracy of sensors.

The estimation system 106 may be electrically connected to the first type of sensor 104. In an embodiment, the first type of sensor 104 includes a mass spectrometer sensor and/or spectroscopic type sensors (e.g. a mass spectrometer, a Raman spectrometer, an absorption spectrometer or a vibrational spectrometer). In an embodiment, one example of the first type of sensor 104 is disclosed in the U.S. Pat. No. 9,666,422. The first type of sensor 104 generates a scan output for a set of gases in the target gas mixture. The scan output includes spectra of detected ions as a function of the mass-to-charge ratio (a first variable) corresponding to the target gas mixture.

The target mixture 102*a* and the standard mixture 102*b* may be liquid mixtures, mixed solutions, mixed solids and others. The first type of sensor 104 may be other type of sensor such as a Raman spectrometer that generates a scan output includes spectra of detected compositions as a function of the wave number that is the first variable.

The estimation system 106 identifies a best peak shape for estimation accuracy of known gas mixtures by analyzing characterization data across the known gas mixtures, with added noise, using machine learning techniques. The best peak shape is referred as, for a given set of accuracy, sensitivity (i.e. minimum incremental concentration detectable) and resolution (i.e. distinguishing between similar ions (similar compositions)) constraints in the application to which the system 106 applies, a peak shape that can meet the constraints best. In an embodiment, the best peak shape is determined from the characterization data. The identification of the best peak shape includes obtaining the best peak shape for the estimation accuracy from the scan output of the first type of sensor 104 for the known gas mixtures. The characterization data refers scan outputs of the first type of sensor 104 from the same known gas mixtures at various parameters settings of the first type of sensor 104. In an embodiment, the parameter to an output shape relationship is varied from sensor to sensor.

The estimation system 106 pre-generates synthetic data with a desired peak shape from an analytical model with standard gas mixture 102*b* as input. The estimation system 106 further defines a cost function to determine a peak shape that is suitable for estimation of the target gas mixture 102*a* from the best peak shape. The estimation system 106 then generates a plurality of actual peak shapes in the first type of sensor 104 for several different instances using standard gas mixtures 102*b* to provide that an actual peak shape among the plurality of actual peak shapes as a calibrating input to calibrate the first type of sensor 104. In an embodiment, for each instance, the actual peak shape is generated based on different parameters of the first type of sensor 104. The estimation system 106 further calibrates the first type of sensor 104 by automatically adjusting the parameters of the first type of sensor 104 for optimizing the actual peak shape to match with the desired peak shape. In an embodiment, the parameter of the first type of sensor 104 includes at least one of a Radio Frequency voltage to Direct Current voltage ratio, Emission Current, voltage gradients and bias voltage. The voltage gradients and individual bias voltage parameter may include (i) box bias, (ii) Filament bias, (iii) Lens bias, (iv) Exit lens bias and (v) quadrupole bias. In an embodiment, the parameters of the first type sensor 104 are adjusted to effectively estimate desired peak shape of a particular gas in the target gas mixture. The estimation system 106 further validates the selected parameters including parameters that are specific to the mass to charge ratio of interest by generating a scan output of a known gas mixture 102*c* to estimate accuracy and peak shape quality. The estimation system 106 may be a computer, a mobile phone, a PDA (Personal Digital Assistant), a tablet, an electronic notebook or a Smartphone. In an embodiment, the first type of sensor 104 is embedded in the estimation system 106.

FIG. 2 illustrates an exploded view of the estimation system 106 of FIG. 1 according to an embodiment herein. The estimation system 106 includes a database 202, a peak shape identification module 204, a synthetic data pre-generation module 206, a cost function defining module 208, an actual peak shape generation module 210, a calibration module 212, a parameters validation module 218 and an estimation module 220. The calibration module 212 includes a parameters optimization module 214 and a range determination module 216. The database 202 stores the characterization data 202*a* of known gas mixtures, a set of constraints 202*b* required for the application to that the system 106 applies, and an analytical model 202*c* of the standard mixtures to generate synthetic data of peak shapes related to the standard gas mixtures 102*b*. The set of constraints 202*b* includes accuracy, sensitivity and resolution required for the application.

The peak shape identification module 204 identifies a best peak shape 204*a* for estimation of known gas mixtures by analyzing characterization data 202*a* across the known gas mixtures that are already analyzed by the first type of sensor 104. The peak shape identification module 204 identifies the best peak shape 204*a* with added noise, using machine learning techniques. The noise to be added is usually a background of spectral component of the application such as a spectral of an air, a carrier gas and others, e.g. noise of circuitries and amplifiers. In the peak shape identification module 204, the best peak shape 204*a* is referred as a peak shape meets the set of constraints 202*b* best.

The synthetic data pre-generation module 206 pre-generates synthetic data with a desired peak shape 206*a* from an analytical model 202*c* with the standard gas mixture 102*b* as input. The desired peak shape 206*a* corresponds to the part or the range of the best peak shape 204*a* in the spectral component of the pre-generated synthetic data of the standard gas mixture 102*b*. The cost function defining module 208 defines a cost function 208*a* to determine a peak shape that is suitable for estimation of the target gas mixture 102*a* from the best peak shape 204*a*. The actual peak shape generation module 210 generates a plurality of actual peak shapes, in the first type of sensor 104, for several different instances using standard gas mixtures 102*b* to provide that an actual peak shape 210*a* among the plurality of actual peak shapes as a calibrating input to calibrate the first type of sensor 104.

The calibration module 212 calibrates the first type of sensor 104 by automatically adjusting parameters of the first type of sensor 104 to find selected parameters 212*a* for optimizing the actual peak shape 210*a* to match with the desired peak shape 206*a*. In an embodiment, the parameters 212*a* to adjusted of the first type of sensor 104 includes at least one of a Radio Frequency voltage to Direct Current voltage ratio, Emission Current, voltage gradients and bias voltage. In another embodiment, the voltage gradients and individual bias voltage parameter includes (i) box bias, (ii) Filament bias, (iii) Lens bias, (iv) Exit lens bias and (v) quadrupole bias. The calibration module 212 includes a parameters optimization module 214 that optimizes the parameters for a mass to charge ratio of interest once the parameters 212*a* to be adjusted are selected. The calibration module 212 also includes a range determination module 216 that determines each of the selected parameters 212*a* is in a predefined range by constraining (i) optimization of the actual peak shape 210*a* and (ii) optimization of each of the selected parameters 212*a* to respective predefined range. The parameters optimization module 214 identifies the optimal parameters by the following equation.

$$Xn+1=Xn-K\cdot Jcf(Xn),$$

Xn=nth set of parameters

K=constant cf(X)=cost function

Jcf(X)=gradient vector of the cost function

The parameters optimization module 214 runs the gradient descent optimization over the selected parameters 212*a* to identify the optimal parameter. The parameters validation module 218 validates the selected parameters 212*a* including parameter that are specific to the mass to charge ratio of interest by generating a scan output of a known gas mixture 102*c* to estimate accuracy and peak shape quality. The estimation module 220 generates a scan output 220*a* of the target gas mixture 102*a* of the first type sensor 104 with the selected parameters 212*a* to estimate the compositions of the target gas mixture 102*a* using the cost function 208*a* from a peak shape in the scan output 220*a*.

FIG. 3 is a flow diagram that illustrates a calibration control loop performed by the calibration module 212 for mass spectrometers that is the first type of sensor 104 of FIG. 1 according to an embodiment herein. At step 302, the calibration module 212 allows to select the parameters (i.e. the global parameters and local parameters) of the first type of sensor 104. At step 304, the calibration module 212 gathers desired peak shape data 206*a* and the actual peak shape data 210*a* for the given standard gas mixture 102*b* from the characterization data 202*a* across various known gas mixtures. At step 306, the calibration module 212 runs gradient descent optimization over the selected parameters 212*a*. At step 308, the calibration module 212 determines whether the actual peak shape 210*a* matches with the desired peak shape 206*a*. If not, the calibration module 212 adds the new parameter and calculates the gradient to determine if the actual peak shape 210*a* matches with the desired peak shape 206*a*. At step 310, the parameters validation module 218 validates the selected parameters 212*a*.

FIGS. 4A-4B are flow diagrams that illustrate a method for optimizing a peak shape for estimating a composition of a target gas mixture 102*a* using the estimation system 106 of FIG. 1 according to an embodiment herein. At step 402, by the estimation module 220, a scan output 220*a* for the target gas mixture 102*a* is generated using the first type of sensor 104. The scan output 220*a* includes spectra of detected ions as a function of the mass-to-charge ratio corresponding to the target gas mixture 102*a*. This step 402 is performed by using the selected parameters at step 412, that is for generating the scan output 220*a* for the target mixture to estimate the compositions of the target gas mixture 102*a*, following steps are performed.

At step 404, by the peak shape identification module 204, a best peak shape 204*a* for estimation of known gas mixtures is identified by analyzing characterization data 202*a* across the known gas mixtures, with added noise, using machine learning techniques. At step 406, by the synthetic data pre-generation module 206, synthetic data with a desired peak shape 206*a* is pre-generated from an analytical model 202*c* with the standard gas mixture 102*b* as input. At step 408, by the cost function defining module 208, a cost function 208*a* is defined to determine a peak shape whether that is suitable for estimation of the target gas mixture 102*a* from the best peak shape 204*a*. At step 410, by the actual peak shape generation module 210, a plurality of actual peak shapes are generated for several different instances in the first type of sensor 104 using standard gas mixtures 102*b* to provide that an actual peak shape 210*a* among the plurality of actual peak shapes as a calibrating input to calibrate the first type of sensor 104.

At step 412, by the calibration module 212, the first type of sensor 104 is calibrated by automatically adjusting parameters of the first type of sensor 104 to find selected parameters 212*a* for optimizing the actual peak shape 210*a* to match with the desired peak shape 206*a*. The parameter of the first type of sensor 104 to be adjusted includes at least one of a Radio Frequency voltage to Direct Current voltage ratio, Emission Current, voltage gradients and bias voltage. In an embodiment, the voltage gradients and individual bias voltage parameter includes (i) box bias, (ii) Filament bias, (iii) Lens bias, (iv) Exit lens bias and (v) quadrupole bias. In an embodiment, a stability of the system 106 is detected by determining whether the selected parameters 212*a* are within the allowable limits. The calibration 412 of the first type of sensor 104 may include steps of (a) optimizing the parameters for a mass to charge ratio of interest once the parameters to be adjusted are selected and (b) determining that each of the selected parameters is in a predefined range by constraining (i) optimization of the actual peak shape and (ii) optimization of each of the selected parameters to respective predefined range. At step 414, by the parameters validation module 218, the selected parameters 212*a* including parameters that are specific to the mass to charge ratio of interest are validated by generating a scan output of a known gas mixture 102*c* to estimate accuracy and peak shape quality.

FIG. 5 illustrates a perspective view of a first type of sensor 104 (a mass spectrometer) according to an embodiment herein. The first type of sensor 104 includes a target gas mixture 102*a*, an electron gun 504, an electric magnet 506, an ion beam 508 and an ion detector 510. The target gas mixture 102*a* to be ionized is obtained from the source 102. Also, the sample gas mixture 102*b* is obtained from the source 102 and ionized when the actual peak shape 210*a* is generated for calibration. The electron gun 504 ionizes particles in the target sample 102*a* by adding or removing electrons from the ionized particles. The electron gun 504 ionizes vaporized or gaseous particles using electron ionization process. The electric magnet 506 in the first type of sensor 104 produces electric or magnetic fields to measure the mass (i.e. weight) of charged particles. The magnetic field separates the ions according to their momentum (i.e. how the force exerted by the magnetic field can be used to separate ions according to their mass). One of examples of the magnetic fields to filter the ions is a quadruple magnetic field. The separated ion is targeted through a mass analyzer and onto the ion detector 510. In an embodiment, differences in masses of the fragments allow the mass analyzer to sort the ions using their mass-to-charge ratio. The ion detector 510 measures a value of an indicator quantity and thus provides data for calculating the abundances of each ion present in the target sample 102*a*. The ion detector 510 records either the charge induced or the current produced when the ion passes by or hits a surface. In an embodiment, the mass spectrum is displayed in the estimation system 106.

A representative hardware environment for practicing the embodiments herein is depicted in FIG. 6. This schematic drawing illustrates a hardware configuration of the estimation system 106 in accordance with the embodiments herein.

The estimation system 106 comprises at least one processor or central processing unit (CPU) 10. The CPUs 10 are interconnected via system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the estimation system 106. The first type of sensor 104 may connect with the system 106 via the I/O adapter 18. The estimation system 106 can read the inventive instructions on the program storage devices and follow these instructions to execute the methodology of the embodiments herein.

The estimation system 106 further includes a user interface adapter 19 that connects a keyboard 15, mouse 17, speaker 24, microphone 22, and/or other user interface devices such as a touch screen device (not shown) or a remote control to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

The estimation system 106 is used to obtain better estimation accuracy from tall and thin peaks which are as close to Gaussian (normal) as possible. The estimation system 106 is used to minimize unit-to-unit (e.g. various mass spectrometers) variation. The estimation system 106 is used to tune the mass spectrometer 104 to various different applications (i.e. an ideal shape for each application is likely to be different and allow the mass spectrometer to be adapted).

One of the aspects of the above is a computer implemented system for optimizing a peak shape for estimating a composition of a target gas mixture, comprising: a first type of sensor 104 that generates a scan output for the target gas mixture, wherein the scan output comprises spectra of detected ions as a function of the mass-to-charge ratio corresponding to the target gas mixture; and an estimation system 106 that is connected to the first type of sensor 104 for estimating the composition of the target gas mixture. The estimation system comprises a memory that stores a database and a set of instructions, and a specialized processor that executes said set of instructions to (a) identify a best peak shape for estimation of known gas mixtures by analyzing characterization data across the known gas mixtures, with added noise, using machine learning, wherein said best peak shape is referred as, for a given set of accuracy, sensitivity and resolution constraints in an application, a peak shape meets the constraints best; (b) pre-generate synthetic data with a desired peak shape from an analytical model with standard gas mixture as input; (c) define a cost function to determine a peak shape that is suitable for estimation of the target gas mixture from the best peak shape; (d) generate a plurality of actual peak shapes, in the first type of sensor 104, for several different instances using standard gas mixtures to provide that an actual peak shape among the plurality of actual peak shapes as a calibrating input to calibrate the first type of sensor 104; (e) calibrate the first type of sensor 104 by automatically adjusting parameters of the first type of sensor 104 for optimizing the actual peak shape to match with the desired peak shape, wherein the parameter of the first type of sensor 104 comprises at least one of a Radio Frequency voltage to Direct Current voltage ratio, Emission Current, voltage gradients and bias voltage; and (f) validate the selected parameters comprising parameters that are specific to the mass to charge ratio of interest by generating a scan output of a known gas mixture to estimate accuracy and peak shape quality. Said calibrate comprises optimizing the parameters for a mass to charge ratio of interest once the parameters to be adjusted are selected; and determining that each of the selected parameters is in a predefined range by constraining (i) optimization of the actual peak shape and (ii) optimization of each of the selected parameters to respective predefined range.

The first type of sensor 104 may include a mass spectrometer. The voltage gradients and individual bias voltage parameter may comprise (i) box bias, (ii) Filament bias, (iii) Lens bias, (iv) Exit lens bias and (v) quadrupole bias.

In another aspect of the above, a computer implemented method for optimizing a peak shape for estimating a composition of a target gas mixture is provided. The method comprising: (a) generating 402, using a first type of sensor 104 a scan output for the target gas mixture, wherein the scan output comprises spectra of detected ions as a function of the mass-to-charge ratio corresponding to the target gas mixture; (b) identifying 404 a best peak shape for estimation of known gas mixtures by analyzing characterization data across the known gas mixtures, with added noise, using machine learning, wherein said best peak shape is referred as, for a given set of accuracy, sensitivity and resolution constraints in an application, a peak shape meets the constraints best; (c) pre-generating 406 synthetic data with a desired peak shape from an analytical model with standard gas mixture as input; (d) defining 408 a cost function to determine a peak shape that is suitable for estimation of the target gas mixture from the best peak shape; (e) generating 410 a plurality of actual peak shapes, in the first type of sensor 104, for several different instances using standard gas mixtures to provide that an actual peak shape among the plurality of actual peak shapes as a calibrating input to calibrate the first type of sensor 104; (f) calibrating 412 the first type of sensor 104 by automatically adjusting parameters of the first type of sensor 104 for optimizing the actual peak shape to match with the desired peak shape; and (g) validating 414 the selected parameters comprising parameters that are specific to the mass to charge ratio of interest by generating a scan output of a known gas mixture to estimate accuracy and peak shape quality. The parameter of the first type of sensor 104 comprises at least one of a Radio Frequency voltage to Direct Current voltage ratio, Emission Current, voltage gradients and bias voltage. Said calibrating comprises optimizing the parameters for a mass to charge ratio of interest once the parameters to be adjusted are selected; and determining that each of the selected parameters is in a predefined range by constraining (i) optimization of the actual peak shape and (ii) optimization of each of the selected parameters to respective predefined range.

In the above computer implemented method, the first type of sensor 104 may include a mass spectrometer. In the above computer implemented method, the voltage gradients and individual bias voltage parameter may comprise (i) box bias, (ii) Filament bias, (iii) Lens bias, (iv) Exit lens bias and (v) quadrupole bias. The above computer implemented method may further include the step of detecting a stability of the system by determining whether the selected parameters are within the allowable limits.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope.

The invention claimed is:

1. A system for estimating compositions of a target mixture using a first type of sensor, the first type of sensor generating a scan output for the target mixture and the scan output including spectra of detected compositions as a function of a first variable, comprising:

a data base for storing characterization data of known mixtures, a set of constraints that includes accuracy, sensitivity and resolution required for an application to which the system applies, and an analytical model of a standard mixture; and a set of modules, wherein the set of modules comprises:

a peak shape identification module that is configured to identify a best peak shape for estimation of the compositions of the known mixtures by analyzing the characterization data across the known mixtures, with added noise as a background of the application, wherein the best peak shape is defined as a peak shape that is best for an estimation of the set of constraints of the application;

a synthetic data pre-generation module that is configured to pre-generate synthetic data with a desired peak shape that is corresponding to the best peak shape from the analytical model with the standard mixture as input;

a cost function defining module that is configured to define a cost function to determine a peak shape for estimation of the compositions of the target mixture from the best peak shape;

an actual peak shape generation module that is configured to generate a plurality of actual peak shapes, in the first type of sensor, for a plurality of different instances using the standard mixture to provide an actual peak shape among the plurality of actual peak shapes as a calibrating input to calibrate the first type of sensor;

a calibration module that is configured to calibrate the first type of sensor by automatically adjusting parameters of the first type of sensor to find selected parameters for optimizing the actual peak shape to match with the desired peak shape; and an estimation module that is configured to estimate the compositions of the target mixture using the cost function from a peak shape of a scan output of first type sensor generating with the selected parameters.

2. The system according to claim 1, wherein the set of modules further includes a parameters validation module that is configured to validate the selected parameters by generating a scan output of a known mixture to estimate accuracy and peak shape quality.

3. The system according to claim 1, wherein the best peak shape identification module identifies the best peak shape with added noise using machine learning.

4. The system according to claim 1, wherein the first type of sensor generates a scan output for a target gas mixture, the scan output comprising the spectra of detected ions as a function of the mass-to-charge ratio corresponding to the target gas mixture, and the calibration module calibrates the first type of sensor by adjusting the parameter, wherein the parameter comprises at least one of a Radio Frequency voltage to Direct Current voltage ratio, an Emission Current, voltage gradients and a bias voltage.

5. The system according to claim 4, wherein the calibration modules includes:

an optimizing module that is configured to optimize the parameters for a mass to charge ratio of interest once the parameters to be adjusted are selected; and a determining module that is configured to determine each of the selected parameters is in a predefined range by constraining (i) optimization of the actual peak shape and (ii) optimization of each of the selected parameters to respective predefined ranges.

6. The system according to claim 4, wherein the first type of sensor includes a mass spectrometer including a quadrupole mass filter.

7. The system according to claim 6, wherein the selected parameter includes the voltage gradients and individual bias voltage, comprising (i) box bias, (ii) Filament bias, (iii) Lens bias, (iv) Exit lens bias and (v) quadrupole bias.

8. The system according to claim 1, further comprising:

a memory that stores the database and the set of modules; and a processor that executes the set of modules.

9. The system according to claim 1, further comprising a first type of sensor.

10. A method implemented on a computer that includes estimating compositions of a target mixture using a first type of sensor, wherein the first type of sensor generates a scan output for the target mixture and the scan output includes spectra of detected compositions as a function of a first variable, wherein the estimating composition includes:

identifying a best peak shape for estimation of the compositions of known mixtures by analyzing characterization data across the known mixtures, with added noise as a background of an application, wherein the best peak shape is defined as for a given set of constraints that includes accuracy, sensitivity and resolution in the application, a peak shape that is best for an estimation of the set of constraints best;

pre-generating synthetic data with a desired peak shape that is corresponding to the best peak shape from an analytical model with standard mixture as input;

defining a cost function to determine a peak shape estimation of the compositions of the target mixture from the best peak shape;

generating a plurality of actual peak shapes, in the first type of sensor, for a plurality of different instances using the standard mixture to provide an actual peak shape among the plurality of actual peak shapes as a calibrating input to calibrate the first type of sensor;

calibrating the first type of sensor by automatically adjusting parameters of the first type of sensor to find selected parameters for optimizing the actual peak shape to match with the desired peak shape; and generating a scan output of the target mixture of the first type sensor with the selected parameters to estimate the compositions of the target mixture using the cost function from a peak shape in the scan output.

11. The method according to claim 10, wherein the estimating composition further includes validating the selected parameters by generating a scan output of a known mixture to estimate accuracy and peak shape quality.

12. The method according to claim 10, wherein the identifying the best peak shape includes identifying the best peak shape with added noise using machine learning.

13. The method according to claim 10, wherein the first type of sensor generates a scan output for a target gas mixture, the scan output comprising the spectra of detected ions as a function of the mass-to-charge ratio corresponding to the target gas mixture, and the calibrating includes calibrating the first type of sensor by adjusting the parameter, wherein the parameter comprises at least one of a Radio Frequency voltage to Direct Current voltage ratio, an Emission Current, voltage gradients and a bias voltage.

14. The method according to claim 13, wherein the calibrating includes:

optimizing the parameters for a mass to charge ratio of interest once the parameters to be adjusted are selected; and determining each of the selected parameters is in a predefined range by constraining (i) optimization of the actual peak shape and (ii) optimization of each of the selected parameters to respective predefined ranges.

15. The method according to claim 13, wherein the first type of sensor includes a mass spectrometer including a quadrupole mass filter and the selected parameter includes the voltage gradients and individual bias voltage, comprising (i) box bias, (ii) Filament bias, (iii) Lens bias, (iv) Exit lens bias and (v) quadrupole bias.

* * * * *